United States Patent [19]

Ostrowski

[11] 4,159,582

[45] Jul. 3, 1979

[54] GRIPPER ELEMENT FOR SPORTS SHOES

[76] Inventor: Eugene J. Ostrowski, 1088 Manor La., Bayshore, N.Y. 11706

[21] Appl. No.: 923,475

[22] Filed: Jul. 10, 1978

[51] Int. Cl.[2] ..... A43C 15/00; A43B 5/00

[52] U.S. Cl. ..... 36/67 D; 36/134

[58] Field of Search ..... 36/67 R, 67 A, 67 B, 36/67 C, 67 D, 134

[56] References Cited

U.S. PATENT DOCUMENTS

| | | | |
|---|---|---|---|
| 1,072,794 | 9/1913 | Tradesco | 36/134 |
| 3,496,656 | 2/1970 | Caine | 36/67 A |
| 3,717,238 | 2/1973 | Fox | 36/61 |

*Primary Examiner*—Patrick D. Lawson

*Attorney, Agent, or Firm*—Arnold L. Albin

[57] ABSTRACT

An improved gripper element for sports shoes, especially adapted for use on artificial turf. The gripper element or spike is recessed below a cover member urged outwardly by a captive resilient member until the wearer's weight is impressed upon his shoe, whereupon the spike is exposed to engage the turf. While used in plurality, individual gripper elements are readily detached and replaced. The resilient member can be optimized to suit the body weight of the wearer and type of athletic activity in which he engages.

9 Claims, 7 Drawing Figures

GRIPPER ELEMENT FOR SPORTS SHOES

BACKGROUND OF THE INVENTION

1. Field of the Invention

This invention relates to gripper elements for sports shoes, and more particularly, to shoes for use on synthetic surfaces such as Astroturf.

Athletic shoes, as used for football, baseball, soccer, track, golf, and other sports require a cleat, spike, or other gripping element, affixed to the sole, so that the wearer of the shoe will not slip on the surface he is walking or running upon. Artificial turf and other synthetic surfaces, in particular, are prone in inducing slippage with conventional cleated athletic shoes.

The subject invention is of a cleat or gripper element which can be affixed either permanently or by a removable fastener to the outsole of a sports shoe, and which provides a highly slip-resistant shoe adapted to use on artificial turf.

2. The prior art employs cleats of fixed construction, made of plastic or metal, which, because of slippage, is not suitable for use on artificial turf. Moreover, conventional spikes tend to lodge in the surface of plastic tracks, requiring excessive force to be exerted in their removable. Hence the use of sports shoes with conventional spikes or gripper elements on plastic tracks and artificial turf for the staging of athletic competition has been unsatisfactory.

The use of conventional spikes has been discontinued for track shoes used on plastic tracks. A gripper element particularly designed for plastic tracks is described in U.S. Pat. No. 3,859,739 issued Jan. 14, 1975 to A. Dassler, where the body of the element prevents undue penetration into a plastic track. However, such spikes still possess the limitations described above the respect to artificial turf.

It has been found that a resiliently mounted spike is capable of affording excellent traction on artificial turf, while being capable of design variation to suit the weight and activities of the wearer. The advantage of this invention over the prior art is that it provides a highly stable, adjustable exposure gripper element, suitable for use where conventional cleats are ineffective. Wearing parts are replaceable, and the spring action provides a range of adjustment to suit the weight and activities of the wearer, as well as enhancing the life of the invention by allowing reduced wear on the contact surfaces.

A sports shoe with spring-loaded gripper elements is described in U.S. Pat. No. 3,496,656 issued Feb. 24, 1970 to W. R. Caine. However this invention was intended only to impart a springiness to the wearer's feet, and suffers a loss of penetration power when compressed under the weight of the wearer, as compared with the subject invention, which provides increased gripping power under these conditions.

SUMMARY OF THE INVENTION

It is, therefore, a principal object of the subject invention to provide an improved gripper element for sports shoes, especially when used on artificial turf.

It is a further object of this invention to provide a plurality of spring-loaded gripper elements for sports shoes which are carried independently and detachably, so as to permit replacement of individual elements.

It is another object of this invention to provide a means for varying the resiliency of the gripper element to suit the weight and activities of the wearer and thus maximize gripping power.

These and other objectives are achieved through the use of a plurality of gripper elements mounted on the outsole of an athletic shoe, having a spring-loaded conical cover for protecting against the entry of foreign materials, the cover also serving as a stop when urged against an inner pin and shoulder, the cover normally concealing a spike which is exposed under the weight of the wearer. A restraining spring, or other resilient member, housed within the cover, serves to conceal the pin when the weight is removed from the shoe.

Further features and objects of the invention will be apparent from an examination of the accompanying drawings which illustrate the invention.

BRIEF DESCRIPTION OF THE DRAWINGS

Referring now to the figures, in which like reference characters refer to like elements in the separate views.

FIG. 6 is a partial sectional view taken along lines 6—6 of

FIG. 3 to show the slot construction;

DESCRIPTION OF THE PREFERRED EMBODIMENT

Figure 2:
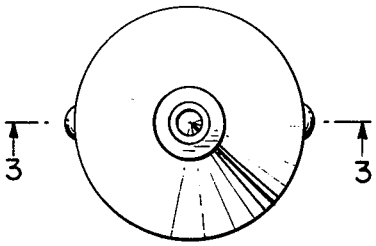
FIG. 2 is a top plan view of the invention.
Figure 1:
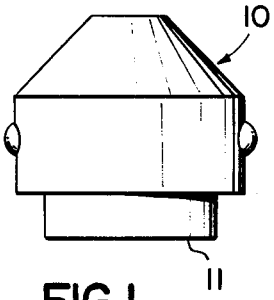
FIG. 1 shows a side view of the present invention.
Figure 3:
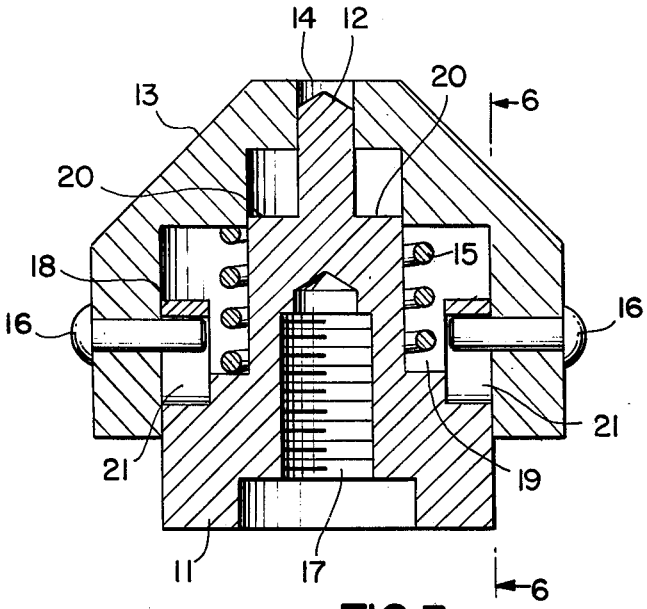
FIG. 3 is a cross-sectional view taken along lines 3—3 of FIG. 2.
Figure 5:
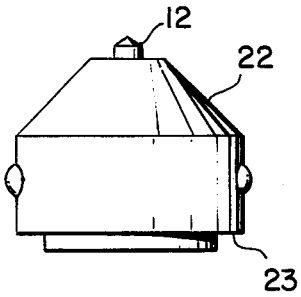
FIG. 5 is a side view of the invention with cover compressed and axial spike exposed.

As shown in FIG. 1, a non-slip gripper element 10 is provided with a base member 11 for securing to the outsole of a sports shoe 28. Extending axially from the base member is a spike 12, upon which a cover 13, having an axial bore 14, is slideably received. Housed within the base member in an annular recess 19 is a spring or other resilient member 15, all as shown in FIG. 3.

Figure 4:
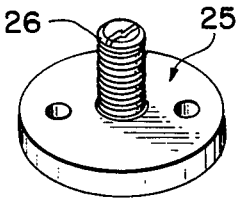
FIG. 4 is a perspective view of the threaded insert used to secure the invention to the sole of a shoe.
Figure 7:
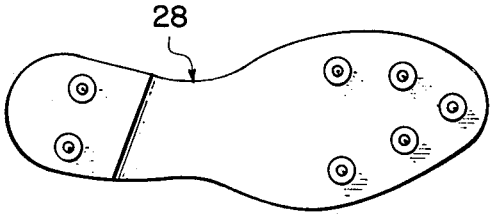
FIG. 7 is a bottom plan view of an athletic shoe with a plurality of the gripper elements installed thereto.

An insert 25, FIG. 4, can be secured to the outsole by any conventional means, such as screws or rivets, through holes provided in a flange therein.

The base member 11 has a threaded axial bore 17 which is adapted to receive the cooperating threads 26 of insert 25. The gripper element is thereby detachably secured to the fixed mounting insert, and may be secured against loosening by an anaerobic glue, such as Loctite, applied to the threaded portions of the members.

The base member, insert, and cover are preferably made from metal by machining or casting, although they may be alternatively molded out of synthetic plastic material such as Delrin or ABS formulation. The resilient member may take the form of a compression spring, wound typically from piano wire of approximately 0.040–0.043 diameter material; however, a plug of an elastomeric material such as commercially available synthetic rubber is also suitable.

In any given application, the relative dimensions of the spike and internal bores, as well as the deflection vs. force characteristic of the spring or elastomer, must be adapted to suit the weight and activities of the wearer. Thus, when the wearer's weight is impressed upon the shoe, the cover of the gripper element will compress the resilient member, exposing the axial spike by the desired amount, which spike then engages the surface on which the activity is taking place. It is readily seen that when the weight is removed from the shoe, the cover will be urged outwards by the spring, concealing the spike.

Figure 6:
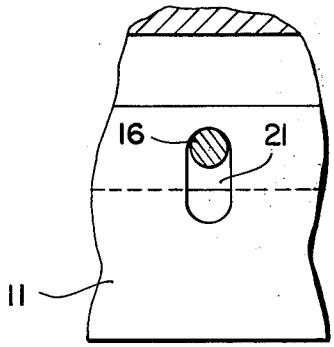

Since the resilient element would project the cover clear of the base member unless restrained, and to prevent compressing the resilient member beyond its elastic limit, means must be provided for limiting the axial movement of the cover. In the embodiment described herein, this objective is achieved by a combination of an axial bore 14 in the cover, which is machined to mate with a stop surface 20 on the base member, and a pin or rivet 16 secured in the cover, which rides in a slotted aperture 21 in the base member, all as shown most clearly in FIGS. 3 and 6.

In the preferred embodiment, the base member 11 is substantially cylindrical, having a first end which forms an axial spike 12, and an opposing second end having a threaded bore 17, with a longitudinal axis extending between the first and second ends. A first cylindrical shoulder 18 extends from the second end to a point midway along the longitudinal axis, although this dimension is not critical and may be varied, but the axial spike should be of short axial length compared to the length of the longitudinal axis. A second cylindrical shoulder 20 extends from the base of the axial spike to an annular recess 19, defined by the vertical walls of the first and second cylindrical shoulders. As is readily observed from the drawings, the spike 12, cylindrical shoulder 20, annular recess 19, and cylindrical shoulder 18 have radii which respectively increase from the center of the spike to the outermost diameter on the base member. Further, the first cylindrical shoulder has at least one opening defining a slot 21 which extends transversely through its sidewall and parallel to the longitudinal axis, which receives the aforementioned pin or rivet to limit the travel of the cover when assembled to the base.

As noted above a compression spring 15 or other resilient element is inserted in the annular recess 19.

The cover member 13 is slideably mounted upon the axial spike, the cover having a series of axial bores of increasing radii for receiving the respective cylindrical shoulders 18 and 20 of the base member, said bores acting as a stop to limit the cover travel when urged to compress the resilient member under the weight of the wearer of the sports shoe. Preferably the cover will have a substantially cylindrical shape at the base end 23, and a conical bevel shape at the axial spike end 22.

To secure the cover to the base member, the latter is provided with an elongated slot 21 extending in the axial direction. A pin or rivet 16, having a cylindrical shank, extends through the sidewall of the cover and is aligned with the slot 21. The pin is a press fit to the cover or may be retained by an epoxy glue, and is slideably received by the slot 21, so as to limit the travel of the cover.

The axial spike may be particularly configured to suit the weight and activity of the wearer, providing maximum traction without slipping nor damage to the bearing surface. Thus, it may be pointed, rounded, serrated, or capped with resilient material. Similarly, the dimensions of the members of the gripper element may be varied to optimize performance. Replacement of gripper elements is facilitated by the threaded insert, and may easily be accomplished in the field without special tools.

While a preferred embodiment has been set forth in the description and the drawings, it will be understood by those skilled in the art that design and structural details may be varied without departing from the true spirit and scope of this invention as defined by the appended claims.

What is claimed is:

1. A non-slip gripper element for sports shoes, such as a shoe for use on artificial turf, comprising:

a. A base member adapted for securing to the outsole of a sports shoe, and having a spike projecting axially therefrom;

b. A cover, having an axial bore, slideably mounted on said spike;

c. Resilient means housed within the cover, for urging the cover away from the base member; and d. Means for limiting the axial movement of the cover.

2. The gripper element as recited in claim 1, further comprising:

a. A substantially cylindrical base member, having a first end, a second end, and a longitudinal axis extending between said first and second ends, said second end having a base adapted to be secured to the outsole of a sports shoe, said first end forming an axial spike of short axial length compared to the length of said base member; further comprising a first cylindrical shoulder extending from said second end to a point midway along said longitudinal axis, said shoulder defining an annular recess, and a second cylindrical shoulder extending along the longitudinal axis from said recess to the base of said spike, such that said spike, said second cylindrical shoulder, said annular recess, and said first cylindrical shoulder have respectively greater radii, said first cylindrical shoulder having at least one opening defining a slot extending longitudinally and transversely through the sidewall;

b. A cover of substantially cylindrical shape, having a beveled first end, a cylindrical second end, and an axial bore, slideably mounted upon said base member, said cylindrical end having one or more holes extending transversely through said sidewall and aligned with the aforesaid slot in said base member, said axial bore having a reduced diameter at its beveled end for receiving said spike, and an enlarged diameter at said opposed cylindrical end for receiving said first shoulder of said base member, and an intermediate diameter for receiving said second shoulder of said base member;

c. Resilient means mounted in said annular recess of said base member and enclosed by said cover;

d. A pin or rivet having a cylindrical shank, secured in said cover within said transverse hole, and slideably received by the elongated slot in said base member, said shank being of substantially the same diameter as said slot; whereby said resilient means tends to urge said cover outwards, restrained by said pin and said elongated slot, concealing said spike within said cover bore, said spike being exposed when the weight of the wearer of the shoe is impressed upon the gripper element.

3. The gripper element of claim 2, wherein said spike further comprises a sharp pointed end.

4. The gripper element of claim 2, wherein said spike further comprises a rounded tip.

5. The gripper element of claim 2, wherein said spike further comprises a tip capped with resilient material.

6. The gripper element of claim 2, wherein said resilient means comprises a compression spring.

7. The gripper element of claim 2, wherein said resilient means further comprises an elastomeric material.

8. The gripper element of claim 2, wherein said spike further comprises a chisel point.

9. In the gripper element of claim 1, the feature that the axial bore of said cover and said base member are so shaped that the cover strikes a stop surface when depressed.

* * * * *

UNITED STATES PATENT AND TRADEMARK OFFICE

CERTIFICATE OF CORRECTION

PATENT NO. : 4, 159, 582

DATED : Jul. 3, 1979

INVENTOR(S) : Eugene J. Ostrowski

It is certified that error appears in the above-identified patent and that said Letters Patent are hereby corrected as shown below:

Line 20, column 1 should read:

2. Description of the Prior Art
The prior art employs....

Signed and Sealed this

*Thirteenth* Day of *November 1979*

[SEAL]

*Attest:*

RUTH C. MASON
*Attesting Officer*

LUTRELLE F. PARKER
*Acting Commissioner of Patents and Trademarks*